US007467432B2

(12) United States Patent
Brogan

(10) Patent No.: US 7,467,432 B2
(45) Date of Patent: Dec. 23, 2008

(54) PILLOW WITH CENTRAL SPACED INTERNAL BAFFLES

(75) Inventor: Ruth L Brogan, Seattle, WA (US)

(73) Assignee: Pacific Coast Feather Company, Seattle, WA (US)

( * ) Notice: Subject to any disclaimer, the term of this patent is extended or adjusted under 35 U.S.C. 154(b) by 0 days.

(21) Appl. No.: 11/735,354

(22) Filed: Apr. 13, 2007

(65) Prior Publication Data

US 2008/0250566 A1 Oct. 16, 2008

(51) Int. Cl.
*A47G 9/10* (2006.01)

(52) U.S. Cl. ..... 5/636; 5/645

(58) Field of Classification Search ..... 5/636, 5/640, 644, 645
See application file for complete search history.

(56) References Cited

U.S. PATENT DOCUMENTS

| | | | | | |
|---|---|---|---|---|---|
| 1,020,444 | A | | 3/1912 | Platt | |
| 1,206,775 | A | * | 11/1916 | Everts | 5/645 |
| 1,385,355 | A | | 7/1921 | Banks | |
| 1,701,124 | A | | 2/1929 | Safford | |
| 2,500,974 | A | | 3/1950 | Angert | |
| 2,589,303 | A | | 3/1952 | Sourbeck | |
| 2,805,428 | A | | 9/1957 | Buchman | |
| 3,283,343 | A | * | 11/1966 | Worcester | 5/644 |
| 3,411,164 | A | * | 11/1968 | Sumergrade | 5/644 |
| 3,849,810 | A | | 11/1974 | Degen | |
| 4,309,784 | A | | 1/1982 | Cohen | |
| 4,513,462 | A | | 4/1985 | Thomas | |
| 4,754,513 | A | | 7/1988 | Rinz | |
| 4,768,248 | A | | 9/1988 | O'Sullivan | |
| 4,829,614 | A | | 5/1989 | Harper | |
| 4,850,068 | A | | 7/1989 | Walpin et al. | |
| 4,862,535 | A | | 9/1989 | Roberts | |
| 4,949,411 | A | | 8/1990 | Tesch | |
| 5,038,432 | A | | 8/1991 | Robillard et al. | |
| 5,088,141 | A | | 2/1992 | Meyer et al. | |
| 5,363,524 | A | | 11/1994 | Lang | |
| 5,367,731 | A | | 11/1994 | O'Sullivan | |
| 5,557,816 | A | | 9/1996 | Pedersen et al. | |
| 5,661,862 | A | | 9/1997 | Ryndak | |
| 5,797,154 | A | | 8/1998 | Contreras | |
| 5,809,594 | A | | 9/1998 | Isogai | |
| 5,819,347 | A | | 10/1998 | Masuda | |
| 5,840,080 | A | | 11/1998 | Der Ovanesian | |
| 5,940,913 | A | | 8/1999 | Horowitz | |
| 6,052,848 | A | | 4/2000 | Kelly | |
| 6,079,066 | A | | 6/2000 | Backlund | |
| 6,170,103 | B1 | | 1/2001 | Wang et al. | |
| 6,345,401 | B1 | | 2/2002 | Frydman | |

(Continued)

*Primary Examiner*—Michael Trettel
(74) *Attorney, Agent, or Firm*—Clark A. Puntigam; Jensen & Puntigam, P.S.

(57) ABSTRACT

The pillow includes first and second fabric sections which are secured around the peripheries thereof to form an interior volume. First and second baffle members are positioned within the interior volume, attached to the first and second fabric sections. The first and second baffle members extend in the longitudinal direction of the pillow about the center thereof and are spaced approximately equidistant laterally from the center line of the pillow. The baffle members either parallel each other or curve away from each other from the midpoints to the free ends thereof. Baffle members are configured and positioned such that there is substantial space between the baffle members, respectively, and the peripheral edge of the pillow.

7 Claims, 3 Drawing Sheets

U.S. PATENT DOCUMENTS 6,471,726 B2 10/2002 Wang
6,574,809 B1 6/2003 Rathbun
6,817,049 B1 11/2004 Hall
6,910,237 B2 6/2005 DiGirolamo
6,931,682 B2 8/2005 Kruger, Jr.
6,952,848 B1 10/2005 Strunk-Fellows
6,976,280 B2 12/2005 Coutts
7,032,264 B2 4/2006 Funatogawa
2001/0029630 A1 10/2001 Cortese et al.
2004/0006822 A1 1/2004 Milligan
2005/0150051 A1 7/2005 Greenawalt et al.
2005/0278852 A1 12/2005 Wahrmund et al.
2006/0075562 A1* 4/2006 DiGirolamo ..... 5/645
2006/0277684 A1 12/2006 Wassilefky

* cited by examiner

PILLOW WITH CENTRAL SPACED INTERNAL BAFFLES

TECHNICAL FIELD

This invention relates generally to pillows with internal baffles, and more particularly concerns such a pillow in which the internal baffles do not contact any of the edges of the pillow.

BACKGROUND OF THE INVENTION

Comfort and support are important features of a pillow. There are many known pillows which have a variety of internal structures to provide specific support and/or comfort characteristics for the user. In some cases, the desired support is for particular therapeutic benefits, while in other cases, the desired support is more for comfort, including enhancing particular sleeping positions of the user. Relative to enhancing different sleeping positions, it would be desirable to have a pillow which is adjustable, i.e. structured so that a single pillow can be used for various sleeping positions, including back, stomach or side, by simply moving or adjusting the position of the filling appropriately within the pillow, with the internal structure of the pillow arranged so as to generally maintain the position of the fill when a desired fill arrangement has been achieved.

SUMMARY OF THE INVENTION

Accordingly a pillow is disclosed herein, comprising: first and second fabric sections, secured around the respective peripheries thereof to form an interior volume between the first and second fabric sections; first and second baffle members positioned within the interior volume, attached to the first and second fabric sections, wherein the first and second baffle members extend approximately parallel to each other or curve away from each other to free ends thereof, and wherein the baffle members are configured and positioned such that there is substantial space between the baffle members, respectively, and the peripheral edge of the pillow; and loose fill within the interior volume of the pillow, the position of which is adjustable by a user.

BEST MODE FOR CARRYING OUT THE INVENTION

Figure 1:
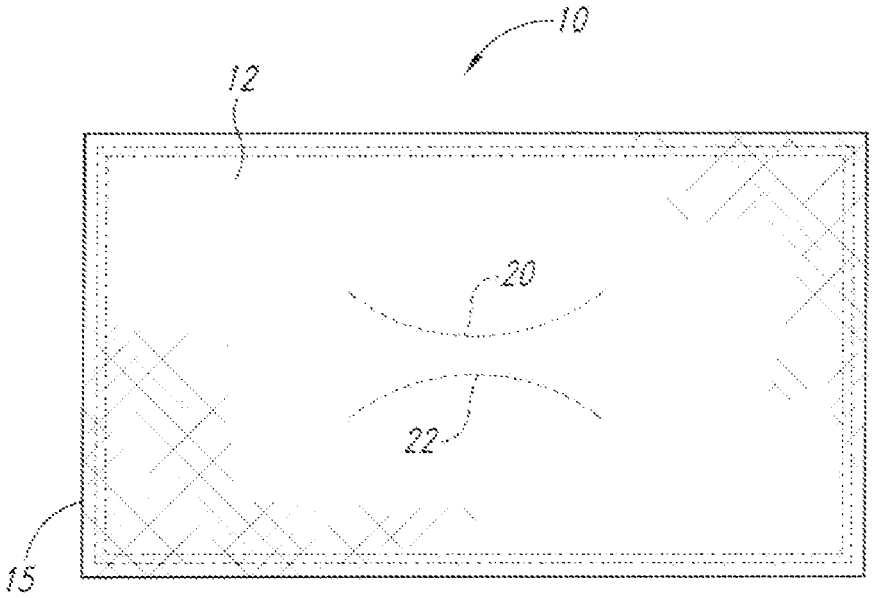
FIG. 1 is a cross-sectional top view of a first embodiment of a baffle pillow described herein.
Figure 2:
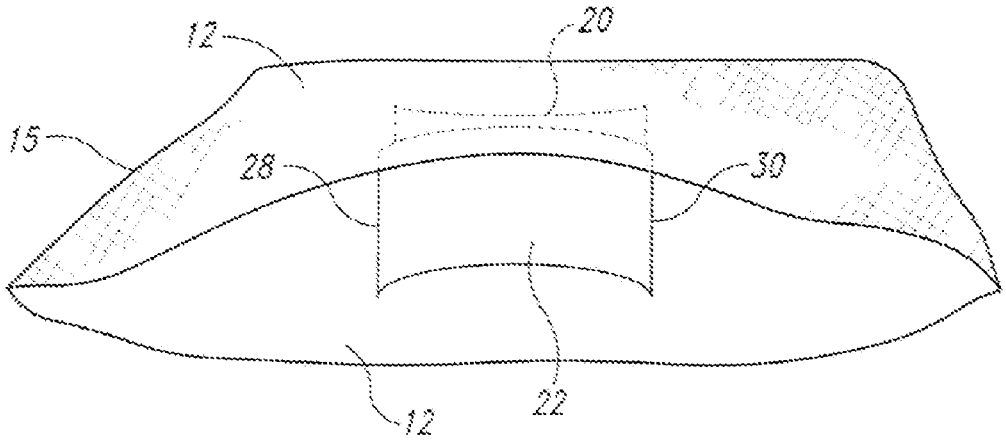
FIG. 2 is a perspective view of the pillow of FIG. 1.

FIGS. 1 and 2 show a first embodiment of the baffle pillow described herein. The pillow 10 includes upper and lower fabric sections 12 and 14. The fabric sections may be made of various materials, including cotton, polyester or other similar material. The two fabric sections 12 and 14 are secured around their respective peripheries 15 by sewing or similar attachment elements. Fabric sections 12, 14 may be different sizes for different size pillows, among them standard, queen and king size, although other sizes are possible. A queen size pillow, for instance, is 20×20 inches.

Positioned between and secured to the two fabric sections 12, 14 are two baffles 20 and 22. The baffles 20 and 22 are also made of fabric. In the embodiment shown, the height of the baffles can vary within a range of four to eight inches, but typically they will be approximately 6 inches high. The length of the baffles will also vary depending upon the size of the pillow. In one example, which is typical, they are approximately one-third the length of the pillow. In one specific embodiment, the baffles are approximately nine inches long. A possible range of length is 6-9 inches.

The baffles are positioned such that they are approximately centered within the pillow in the longitudinal dimension of the pillow and centered about a center point in the lateral dimension of the pillow. In FIGS. 1 and 2, the baffle members 20 and 22 are positioned so that they are closest at the respective center points thereof, and then curve away from each other to their free ends, e.g. ends 28 and 30 of baffle 22. In the embodiment shown, the baffles 20 and 22 are separated by approximately 2-½ inches at the center points thereof, and approximately 8-½ inches at the endpoints thereof. These distances can, however, vary to some extent. The baffles are not secured to nor do they contact the peripheral edges of the fabric sections.

Fill, e.g. down, feathers or polyester pieces, or combinations thereof, is blown into the interior of the pillow to complete the pillow structure.

Figure 5:
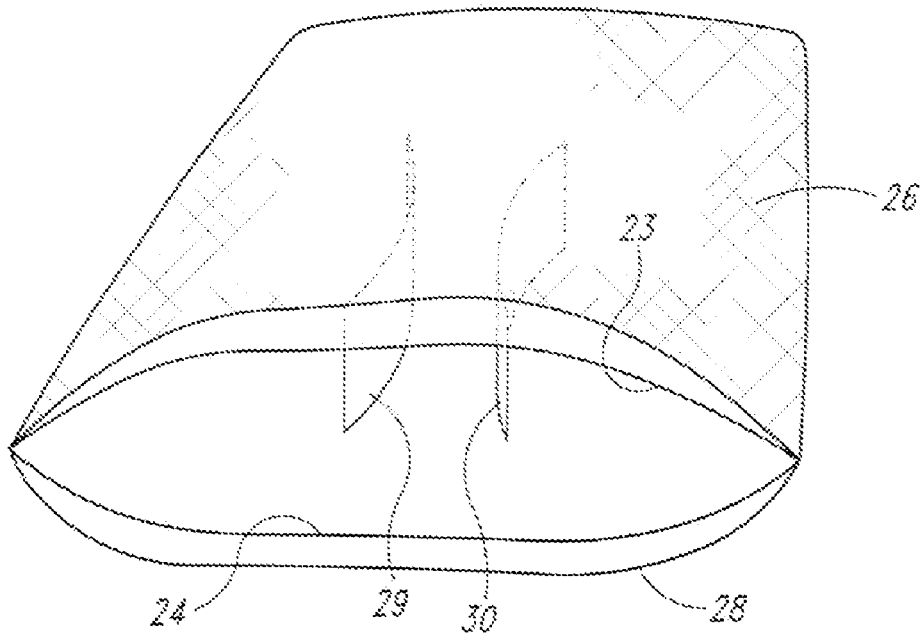
FIG. 5 is a perspective view of an alternative embodiment of the pillow of FIGS. 1 and 2.

FIG. 5 shows an alternative embodiment in which outer fabric layers 26 and 28 are added to inner fabric layers 23 and 24. The outer layers 26 and 28 are approximately the same size as layers 23 and 24. Baffles 29 and 30 are secured to the inner layers 23 and 24. Fill is blown into the volumes between the inner and outer layers as well as into the interior of the pillow, between layers 23 and 24.

Figure 3:
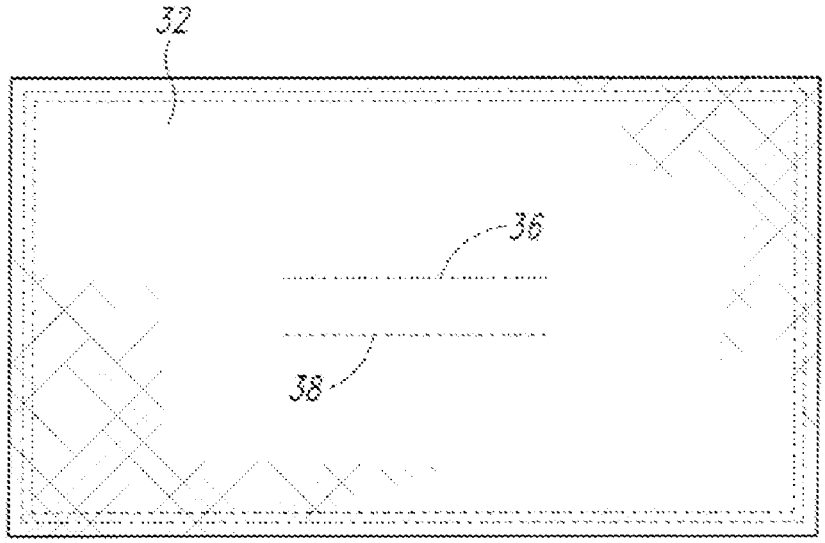
FIG. 3 is a cross-sectional top view of another embodiment of the pillow shown in FIG. 3.
Figure 4:
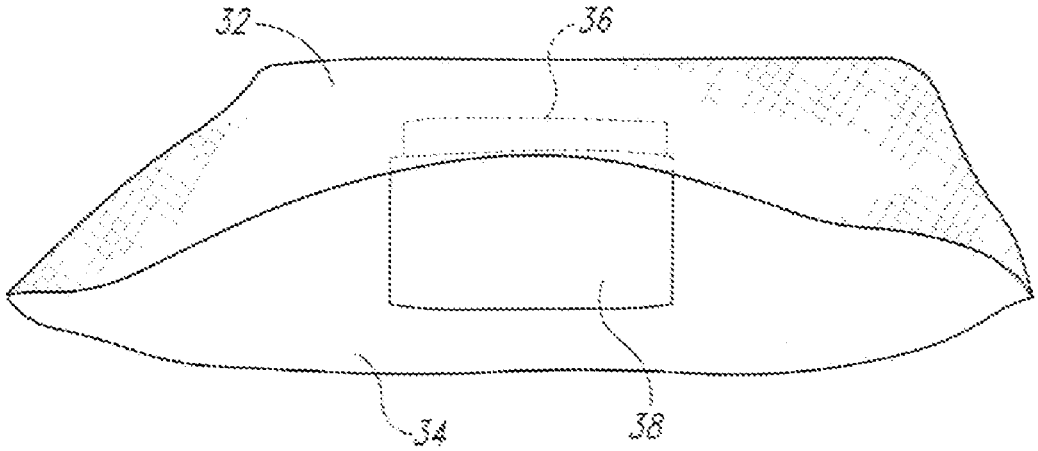
FIG. 4 is a perspective view of the embodiment of FIG. 3.

FIGS. 3 and 4 show another embodiment of the baffle pillow, which includes fabric layers 32 and 34 and baffle members 36 and 38. In this embodiment, baffle members 36 and 38 are straight and parallel each other. They are also typically centered longitudinally within the pillow and also spaced equidistant from the lateral center point of the pillow. They are secured to the fabric sections 32 and 34 and are not secured to nor do they contact and the peripheral edges of the respective fabric sections. They extend for approximately one-third the length of the pillow. Hence, there is substantial space between the baffle members and the peripheral edge 40 of the pillow. The baffles 36 and 38 are separated by approximately 4-½ inches along the lengths thereof and in one embodiment are approximately nine inches long, although these dimensions can vary, with a separation distance in the range of 2-5 inches and a length within the range of 6-9 inches.

Figure 6:
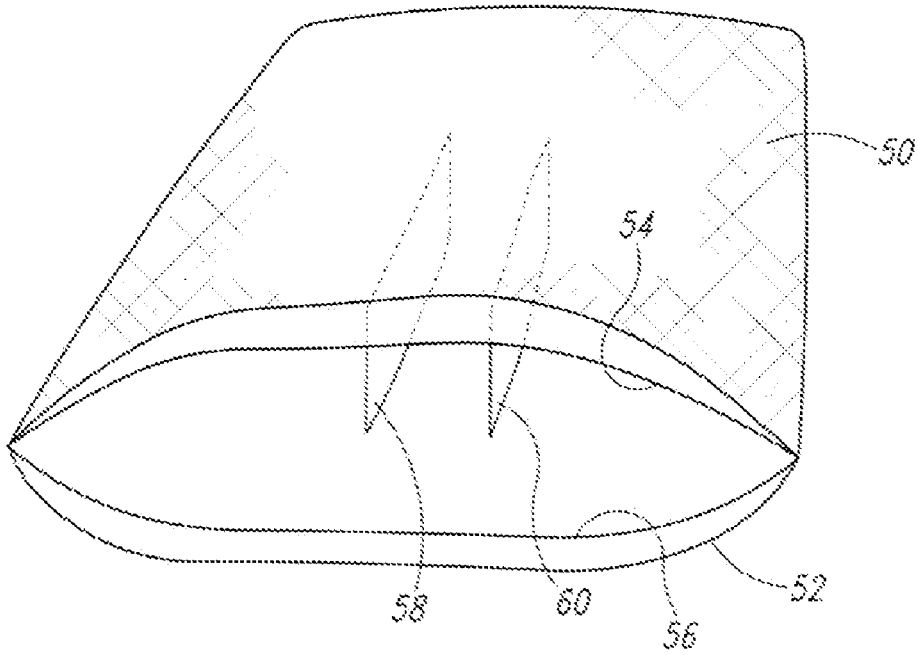
FIG. 6 is a perspective view of an alternative embodiment of the pillow of FIGS. 3 and 4.

FIG. 6 shows an alternate embodiment to that of FIGS. 3 and 4. In this embodiment, outer fabric layers 50 and 52 are added to inner fabric layers 54 and 56. The outer fabric layers are approximately the same size as inner fabric layers 54 and 56. Baffle members 58 and 60 are secured to fabric layers 54 and 56. Fill is blown into the volumes between the inner and outer layers as well as into the interior of the pillow between inner layers 54 and 56.

Baffle members 20 and 22 in the embodiments of FIGS. 1 and 2 and 23 and 24 in FIG. 5, and baffle members 36 and 38 in the embodiment of FIGS. 3 and 4 and 58 and 60 in FIG. 6, as shown and described, permit fill to be moved about the interior volume of the pillow, by the user, for different sleeping positions. The baffles then tend to maintain the position of the fill. The user can, however, rearrange the fill thereafter for a different sleeping position. This pillow can be filled with natural materials such as feathers and down or a combination thereof or with synthetic fills, as well as a combination of natural and synthetic fills. The arrangement/position of the fill within the pillow, being loose fill, can be adjusted by the user to provide a particular support/comfort arrangement corresponding to the position of the user during sleep, as discussed above.

Accordingly, a pillow structure has been disclosed which is adjustable to enhance various sleeping positions for the user.

Although a preferred embodiment of the invention has been disclosed here for the purposes of illustration, it should be understood that various changes, modifications and substitutions may be incorporated in the embodiment without departing from the spirit of the invention, which is defined by the claims which follow.

What is claimed is:

1. A pillow, comprising:

first and second fabric sections, secured around the respective peripheries thereof to form an interior volume between the first and second fabric sections;

first and second baffle members positioned within the interior volume, attached to the first and second fabric sections, wherein the first and second baffle members extend approximately parallel to each other or curve away from each other to free ends thereof, and wherein the baffle members are configured and positioned such that there is substantial space between the baffle members, respectively, and the peripheral edge of the pillow, wherein the baffle members are closest to each other at the respective midpoints thereof and curve away from each other to the endpoints thereof; and loose fill within the interior volume of the pillow, the position of which is adjustable by a user.

2. The pillow of claim 1, wherein the baffle members have a height of approximately seven inches, and a length which is approximately nine inches.

3. The pillow of claim 1, wherein the baffle members are separated by a distance within the range of approximately 2 ½-5 inches at the midpoints thereof.

4. The pillow of claim 1, including third and fourth fabric sections secured, respectively, to the peripheries of the first and second fabric sections, creating interior volumes between the first and third fabric sections and the second and fourth fabric sections, wherein the baffle members are secured only to the first and second baffle members, and further including loose fill in the interior volumes.

5. The pillow of claim 1, wherein the curved baffles are separated by approximately 4-½ inches at the midpoints thereof and approximately 8-½ inches at the free ends thereof.

6. A pillow, comprising:

first and second fabric sections, secured around the respective peripheries thereof to form an interior volume between the first and second fabric sections;

first and second baffle members positioned within the interior volume, attached to the first and second fabric sections, wherein the first and second baffle members extend approximately parallel to each other or curve away from each other to free ends thereof, and wherein the baffle members are configured and positioned such that the baffle members extend for approximately on the order of only 30% to 45% of the distance between those opposing portions of the peripheral edge of the pillow which are spaced from the free ends of the baffle members, sufficient to allow ease of movement of fill between the baffle members and the peripheral edge of the pillow; and loose fill within the interior of the pillow, the position of which is adjustable by a user because of the substantial space between the baffle members and the peripheral edge of the pillow.

7. The pillow of claim 1, wherein the baffle members extend for approximately one-third of the distance between the opposing portions of the peripheral edge of the pillow.

* * * * *